US011338974B2

(12) United States Patent
Dhodapkar et al.

(10) Patent No.: US 11,338,974 B2
(45) Date of Patent: May 24, 2022

(54) LOW STRESS PACKAGING DESIGN TO MINIMIZE PELLET BLOCKING

(71) Applicant: Dow Global Technologies LLC, Midland, MI (US)

(72) Inventors: Shrikant Dhodapkar, Freeport, TX (US); Rocklyn P. Gravouilla, Plaquemine, LA (US); William B. Bellefontaine, Plaquemine, LA (US); Fernanda Bortolane Bueno, Sao Paulo (BR)

(73) Assignee: Dow Global Technologies LLC, Midland, MI (US)

( * ) Notice: Subject to any disclaimer, the term of this patent is extended or adjusted under 35 U.S.C. 154(b) by 554 days.

(21) Appl. No.: 16/325,570

(22) PCT Filed: Aug. 8, 2017

(86) PCT No.: PCT/US2017/045902
§ 371 (c)(1),
(2) Date: Feb. 14, 2019

(87) PCT Pub. No.: WO2018/034887
PCT Pub. Date: Feb. 22, 2018

(65) Prior Publication Data

US 2021/0284412 A1 Sep. 16, 2021

Related U.S. Application Data

(60) Provisional application No. 62/377,062, filed on Aug. 19, 2016.

(51) Int. Cl.
*B65D 71/00* (2006.01)
*B65D 19/38* (2006.01)

(52) U.S. Cl.
CPC ..... *B65D 71/0096* (2013.01); *B65D 19/385* (2013.01); *B65D 2519/00034* (2013.01);
(Continued)

(58) Field of Classification Search
CPC ..... B65D 71/0096; B65D 19/385; B65D 2519/00174; B65D 2519/00034;
(Continued)

(56) References Cited

U.S. PATENT DOCUMENTS 3,946,883 A 3/1976 Beal
3,993,191 A * 11/1976 Membrino ..... B65D 19/0012 206/386

(Continued)

FOREIGN PATENT DOCUMENTS

CA 2530629 C 7/2013
DE 2044271 A1 10/1971

(Continued)

*Primary Examiner* — Rafael A Ortiz
(74) *Attorney, Agent, or Firm* — Quarles & Brady LLP

(57) ABSTRACT

Packaging configuration comprising: a pallet comprising a top surface, a bottom surface and a height HP; a first stack of bagged goods having a total height HL1, stacked on the pallet and comprising at least two layers; and a support structure comprising at least four walls situated over the first stack of bagged goods, one of the walls being a top wall and at least three of the walls being sidewalls. The support structure has a height HC that meets one of the following equations: HC>HL1, when the bottom end of at least one sidewall of the support structure is positioned on the top surface of the at least one pallet; or HC>HP+HL1, when the bottom end of at least one sidewall of the support structure and the bottom surface of the pallet are both positioned on the same surface. An air gap having a height HAG is situated between a top layer of the first stack of bagged goods and the top wall of the support structure.

13 Claims, 7 Drawing Sheets

(52) U.S. Cl.
CPC ..... *B65D 2519/00069* (2013.01); *B65D 2519/00174* (2013.01); *B65D 2519/00273* (2013.01); *B65D 2519/00293* (2013.01); *B65D 2519/00323* (2013.01); *B65D 2519/00497* (2013.01); *B65D 2519/00711* (2013.01); *B65D 2571/00018* (2013.01)

(58) Field of Classification Search
CPC ..... B65D 2519/00069; B65D 2519/00273; B65D 2519/00293; B65D 2519/00323; B65D 2519/00497; B65D 2519/00711; B65D 2571/00018
USPC ..... 206/386
See application file for complete search history.

(56) References Cited

U.S. PATENT DOCUMENTS

| | | | | |
|---|---|---|---|---|
| 5,029,753 | A | 7/1991 | Hipon et al. | |
| 5,144,897 | A | 9/1992 | Avery | |
| 6,112,672 | A | 9/2000 | Heil | |
| 6,837,377 | B2 | 1/2005 | Shuert | |
| 7,320,403 | B2 | 1/2008 | May, Jr. | |
| 7,455,179 | B2 | 11/2008 | Bringard et al. | |
| 7,640,867 | B2 | 1/2010 | Ogburn et al. | |
| 7,654,440 | B2 | 2/2010 | Quaintance et al. | |
| 7,823,765 | B2 | 11/2010 | Weimer | |
| 8,113,351 | B2 | 2/2012 | Durco | |
| 9,126,721 | B2 | 9/2015 | Dye et al. | |
| 9,238,355 | B2 | 1/2016 | Bensason et al. | |
| 2010/0147738 | A1* | 6/2010 | Green | B65D 71/0096 206/736 |
| 2014/0008255 | A1* | 1/2014 | Iwata | B65D 19/18 206/386 |
| 2015/0014264 | A1 | 1/2015 | Linnell, Sr. et al. | |

FOREIGN PATENT DOCUMENTS

| | | | | |
|---|---|---|---|---|
| DE | 20208624 | * | 8/2002 | |
| DE | 20208624 | U1 | 8/2002 | |
| EP | 1657169 | B1 | 1/2007 | |
| GB | 2526704 | A * | 12/2015 | B65D 21/0201 |
| GB | 2526704 | A | 12/2015 | |
| JP | S4818575 | U | 3/1973 | |
| JP | 55046583 | U | 5/1975 | |
| JP | H107144 | A | 1/1998 | |
| JP | 2006248598 | A | 9/2006 | |
| WO | 97/20743 | A1 | 6/1997 | |
| WO | 99/07618 | A1 | 2/1999 | |
| WO | 01/12716 | A2 | 2/2001 | |

* cited by examiner

Support Structure on Ground Surface

Top Load On Pallet

Top Load On Reinforced Top Wall of Support

Support Structure on Pallet Top Surface

LOW STRESS PACKAGING DESIGN TO MINIMIZE PELLET BLOCKING

REFERENCE TO RELATED APPLICATIONS

This application claims priority to U.S. Application No. 62/377,062, filed Aug. 19, 2016, and incorporated herein by reference,

FIELD OF THE INVENTION

This present disclosure is directed to a packaging configuration for use with stacked loads, and more particularly for use with a stack of pelletized elastomer bagged goods.

BACKGROUND OF THE INVENTION

A conventional method of shipping and storing bagged goods utilizes pallets upon which the bagged goods are stacked in layers on top of each other. Polyolefin elastomers are typically supplied to consumers in 20-25 kg bags or supersacks in free-flowing pelletized form. Examples of such elastomers include grades of ENGAGE™ Polyolefin Elastomers and AFFINITY™ Polyolefin Plastomers, INFUSE™ Olefin Block Copolymers, and VERSIFY™ Elastomers, available from the Dow Chemical Company.

Various complex pallet designs and assemblies have been described, for example, in U.S. Pat. No. 6,837,377 (Shuert), U.S. Pat. No. 7,654,440 (Quaintance), U.S. Pat. No. 8,113,351 (Durco), U.S. Pat. No. 7,640,867 (Ogburn), and EP 1657169 (Foden).

The typical configuration of a pallet of bagged elastomers is eleven layers of height with five bags per layer. The total height of the bag stack is generally 60 to 75 inches and the pallet footprint is typically 42 inches wide by 48 inches long. The static load (consolidation stress) placed on the bottom layer of bagged goods on the pallet can be estimated by the following equation: Load (stress)=Bulk Density×Unsupported Height. In general, the stress placed onto the bottom bag of an eleven bag stack is about 165 $lb/ft^2$.

Polyolefin elastomers are prone to blocking, which is sometimes called "massing." Static load can compress the pellets, which maximizes the contact surface area between pellets. The resulting deformation can result in physical interlocking of the pellets and loss of flowability. A particular shipment's susceptibility to massing or blocking can be affected by the static load and consolidation stress placed on the bagged material, temperature conditions, as well as the time of exposure to load and high temperature. The higher the pressure, the greater the deformation, which becomes worse for lower layers of the stacked bagged pellets. This is especially true of lower density polyolefin elastomers ($d<0.875$ $g/cm^3$). Lowering the stress on bottom layers of the stacked bags will reduce overall blocking of the bagged material.

To minimize the potential effect of time, temperature and static load, typical procedures are set whereby material is utilized on a "first in, first out" (FIFO) basis. However, while operating according to FIFO and storage in climate controlled environment generally address time and temperature factors, those measures do not the adequately address the consolidation stress factor with relation to bagged elastomer products. Another approach is to coat the polymer pellets with an anti-blocking agent. See for example, International Publication WO 2001/12716. However, such coating procedures require additional materials which add cost to the pellet production.

One approach to overcome such problems is shipping bagged elastomer products on pallets as reduced loads (e.g., half the typical weight) or in half-filled boxes. However, this procedure increases shipping and packaging costs significantly making it unacceptable to the industry and consumers.

Therefore, there is a need for a system for minimizing the effects of consolidation stress on bagged goods, particularly bagged elastomer products, while maintaining shipping efficiency.

SUMMARY OF THE INVENTION

The invention provides a packaging configuration that mitigates the effects of consolidation stress on bagged goods, particularly bagged elastomeric materials, while enhancing and maintaining efficiencies in shipping such products.

A packaging configuration is provided, which comprises at least the following:

A. A pallet comprising a top surface, a bottom surface and a height ($H_P$);

B. A first stack of bagged goods, stacked on the pallet, and comprising at least two layers, and wherein the first stack of bagged goods has a total height ($H_{L1}$); and C. A support structure situated over, and at least partially enclosing, the first stack of bagged goods, the support structure comprising at least four walls, wherein one of the walls is a top wall, and wherein at least three of the walls are sidewalls that are each, independently, in a perpendicular orientation to the top wall, and wherein the support structure has a height ($H_C$) that meets one of the following equations:

(i) $H_C>H_{L1}$, when the bottom end of at least one sidewall of the support structure is positioned on the top surface of the at least one pallet; or (ii) $H_C>H_P+H_{L1}$, when the bottom end of at least one sidewall of the support structure and the bottom surface of the pallet are both positioned on the same surface; and wherein an air gap is situated between a top layer of the first stack of bagged goods and the top wall of the support structure, and the air gap has a height ($H_{AG}$); and wherein the top wall is optionally detachable from the side walls.

BRIEF DESCRIPTION OF THE DRAWINGS

Embodiments of the present invention are illustrated by way of example, and are not limited by the accompanying figures, in which like references indicate similar elements. Elements in the figures are illustrated for simplicity and clarity and have not necessarily been drawn to scale.

DETAILED DESCRIPTION

Figure 4A:
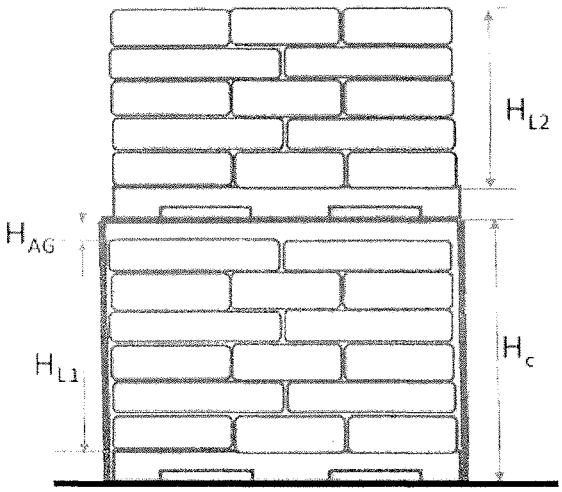
FIGS. 4*a* and 4*b* depict two packaging configurations, each with the support structure on the ground.
Figure 4B:
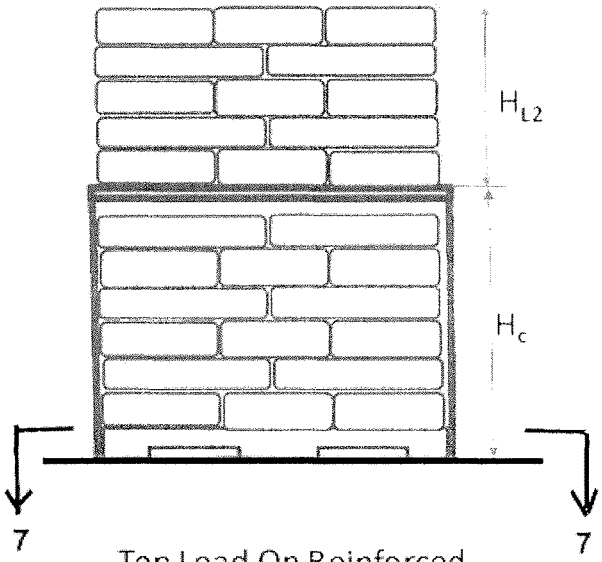
Figures 5A, 5B:
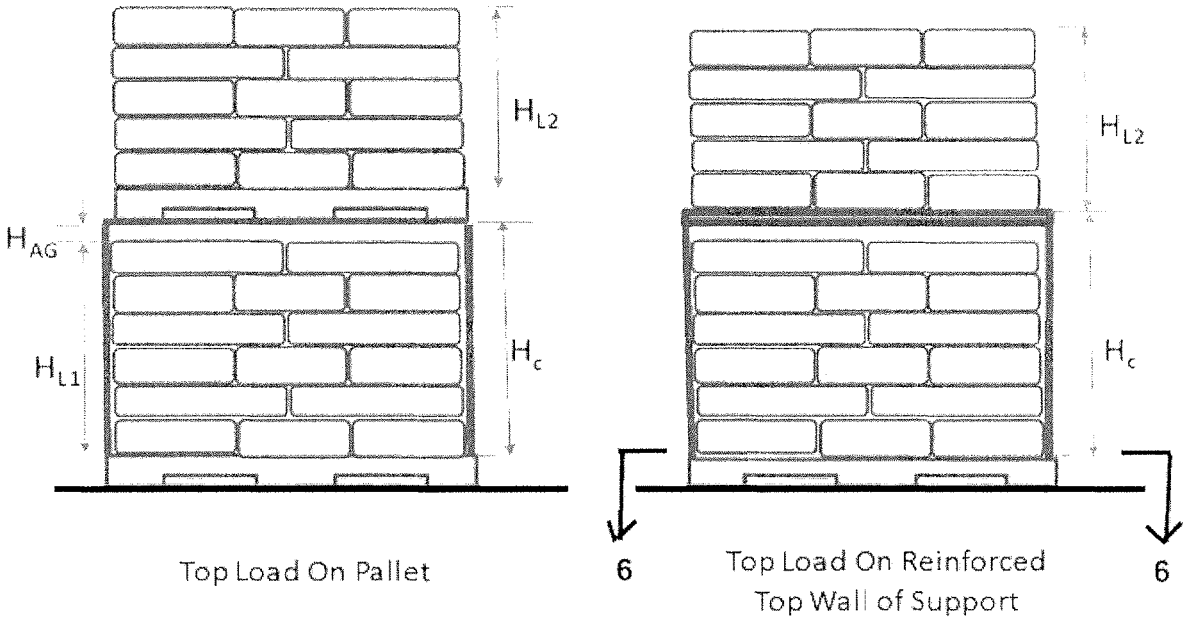
FIGS. 5*a* and 5*b* depict two packaging configurations, each with the support structure on the pallet.

In a general form, the packaging configuration of the invention includes a pallet supporting two or more layers of bagged goods, and a support structure having at least three sidewalls including a top wall and at least two side panels, placed over the bagged goods stacked on the pallet. In an embodiment, the bottom end of the support structure is positioned on the top surface of the pallet (see, for example, FIGS. 5*a* and 5*b*). In another embodiment, the bottom end of the support structure is positioned on the same surface as the bottom end of the pallet (see, for example, FIGS. 4*a* and 4*b*). In embodiments of the packaging configuration, a rigid support panel is placed onto the top wall of the support structure. In embodiments of the packaging configuration, a load of one or more layers of bagged goods is stacked on the rigid support panel. In embodiments, components of the packaging configuration are secured together with a plastic film such as a shrink-wrap film.

The packaging configuration of the invention effectively reduces the stress on a lower load (e.g., half pallet, or e.g., bottom six layers of an 11-bag stack) of stacked bagged goods (e.g., stacked on the pallet) by supporting an upper load (e.g., half pallet, or e.g., top five layers of an 11-bag stack) of bagged goods on a support structure that is placed over the lower load of bagged goods. With the present packaging configuration, the weight of the upper load of bagged goods is supported and transferred through load bearing, vertical side panels of the support structure, thereby reducing the effective load (stress) that is placed onto the lower load of stacked bagged goods, resulting in reduced massing (blocking—see definition) of the bagged goods, for example, polymer pellets among other materials. In embodiments, the present packaging configuration significantly reduces the load stress on lower layers of stacked bags of goods (e.g., elastomeric pellets), which in turn, can reduce massing of bagged elastomeric pellets.

The following calculation can be performed to determine the percent change in stress on the bottom layer of bags of the bottom load of bagged goods of the present packaging configuration.

$$\Delta = \frac{H_{L2}}{(H_{L1} - H_{L2})} \cdot 100$$

Where, $\Delta$=Percent change in stress on the bottom layer of bags of the bottom load, $H_{L1}$=Total height of the first stack of bagged goods (bottom load), and $H_{L2}$=Total height of the second stack of bagged goods (top load).

Figure 8A:
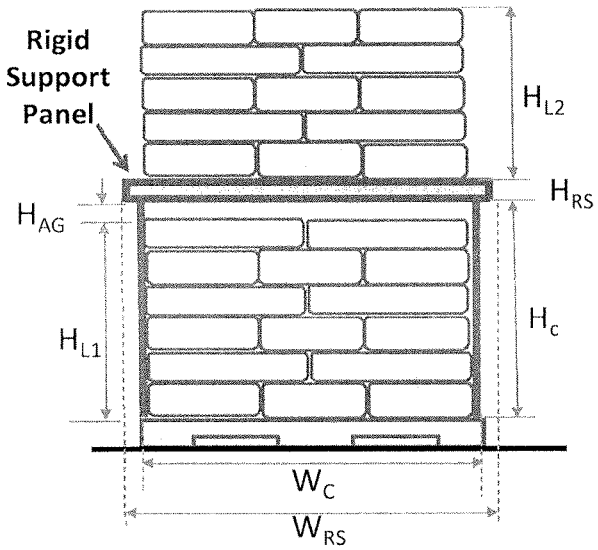
FIGS. 8*a* and 8*b* depict two packaging configurations, each containing a rigid support panel.
Figure 8B:
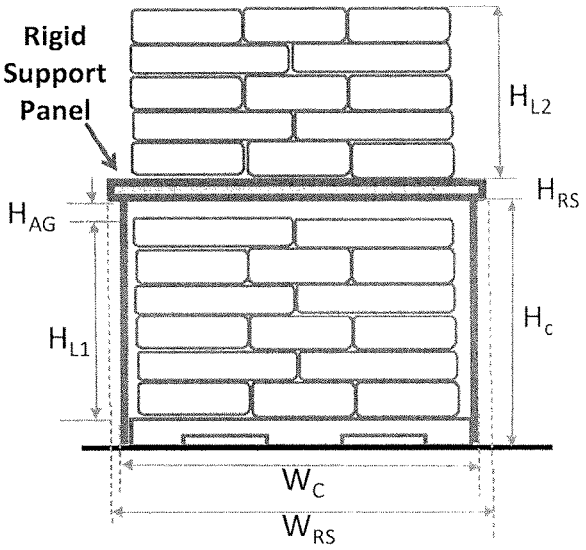

As discussed above, a packaging configuration is provided, which comprises at least the following:

A. A pallet comprising a top surface, a bottom surface and a height ($H_P$);

B. A first stack of bagged goods, stacked on the pallet, and comprising at least two layers, and wherein the first stack of bagged goods has a total height ($H_{L1}$); and C. A support structure situated over, and at least partially enclosing, the first stack of bagged goods, the support structure comprising at least four walls, wherein one of the walls is a top wall, and wherein at least three of the walls are sidewalls that are each, independently, in a perpendicular orientation to the top wall, and wherein the support structure has a height ($H_C$) that meets one of the following equations;

(i) $H_C > H_{L1}$, when the bottom end of at least one sidewall of the support structure is positioned on the top surface of the at least one pallet (for example, see FIGS. 5*a*, 5*b* and 8*a*); or (ii) $H_C > H_P + H_{L1}$, when the bottom end of at least one sidewall of the support structure and the bottom surface of the pallet are both positioned on the same surface (for example, see FIGS. 2, 3, 4*a*, 4*b* and 8*b*); and wherein an air gap is situated between a top layer of the first stack of bagged goods and the top wall of the support structure, and the air gap has a height ($H_{AG}$); and wherein the top wall is optionally detachable from the side walls.

A packaging configuration may comprise a combination of two or more embodiments described herein.

In one embodiment, the pallet comprises a uniform flat surface with no protrusions or cavities.

In one embodiment, the surface is a floor of a building.

In one embodiment, the surface is a floor of a shelf of an open cabinet.

In one embodiment, the bottom end of at least one sidewall of the support structure and the bottom surface of the pallet are both positioned on the same surface In one embodiment, the height ($H_{AG}$) of the air gap is from 1 cm to 6 cm, or from 1 cm to 5 cm, or from 1 cm to 4 cm, or from 1 cm to 3 cm, or from 1 cm to 2 cm.

In one embodiment, the air gap is continuous between the top layer of the first stack of bagged goods and the top wall of the support structure.

In one embodiment, the support structure comprises less than, or equal to, 5 walls.

In one embodiment, the support structure comprises less than, or equal to, 4 sidewalls.

In one embodiment, the top wall of the support structure comprises a removable top cover.

In one embodiment, the support structure comprises a latching mechanism. For example, see FIG. 3.

In one embodiment, the strength of the top wall of the support structure is such, that the maximum deflection under a static load or under a dynamic load, each at ambient conditions, is less than the height of the air gap ($H_{AG}$).

In one embodiment, the support structure does not contain an inner wall that partitions the area enclosed within the support structure.

In one embodiment, the support structure does not comprise a bottom wall which opposes the top wall.

In one embodiment, the support structure and pallet are not interconnected.

In one embodiment, the packaging configuration further comprises a rigid support panel situated upon the top wall of the support structure.

In one embodiment, the rigid support panel comprises a pallet.

In one embodiment, the rigid support panel comprises a flat sheet of rigid material.

In one embodiment, the rigid support panel is situated over, and/or in contact with, at least the two sidewalls, and wherein the rigid support is in perpendicular orientation to each sidewall. For example, see FIGS. 4*b*, 5*b*, 8*a* and 8*b*.

In one embodiment, the packaging configuration further comprising a second stack of bagged goods stacked on the rigid support panel.

Figure 9:
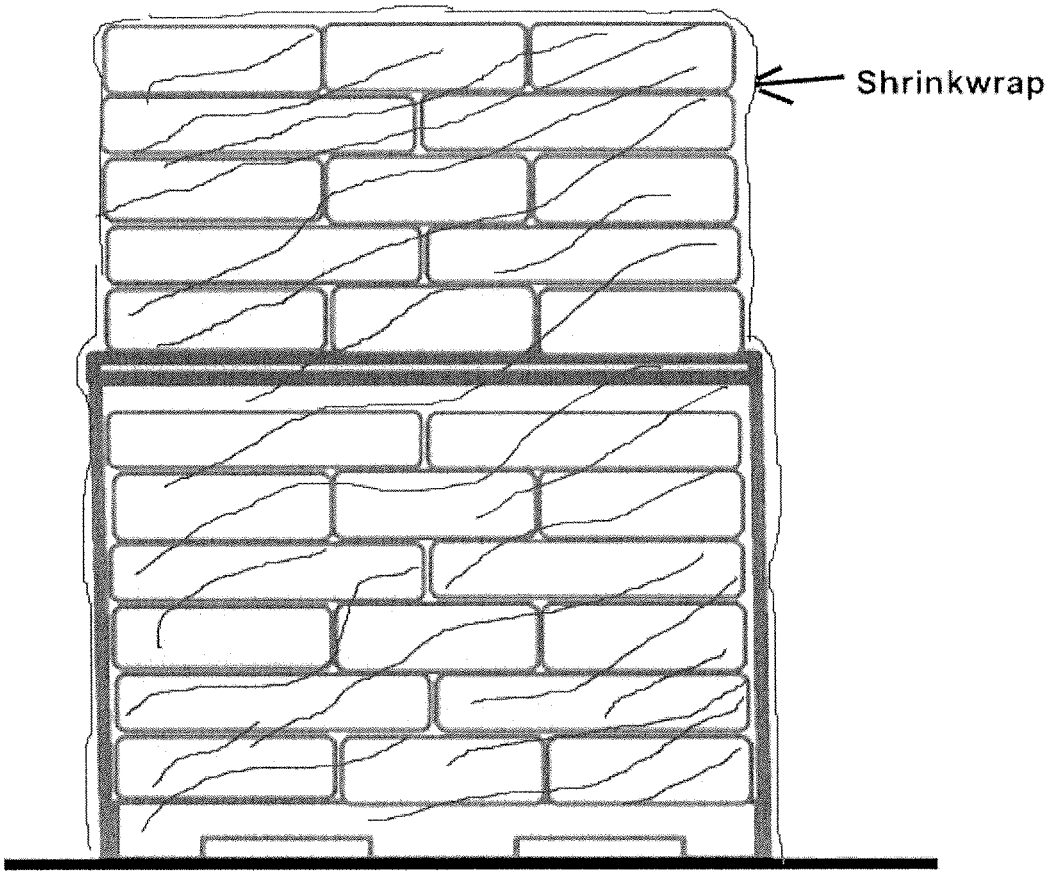
FIG. 9 depicts a packaging configuration secured together with a plastic film such as a shrink-wrap film.

In one embodiment, the packaging configuration is secured together by at least one plastic film. For example, see FIG. 9.

In one embodiment, the plastic film comprises a shrink-wrap film or a stretch hood packaging film.

In one embodiment, the bagged goods comprise free-flowing polymer pellets, and further free-flowing elastomeric polymer pellets.

Also is provided a method of securing one or more stacks of bagged goods on a pallet, said method comprising packaging the bagged goods using the packaging configuration of anyone or more embodiments described herein.

Figure 1:
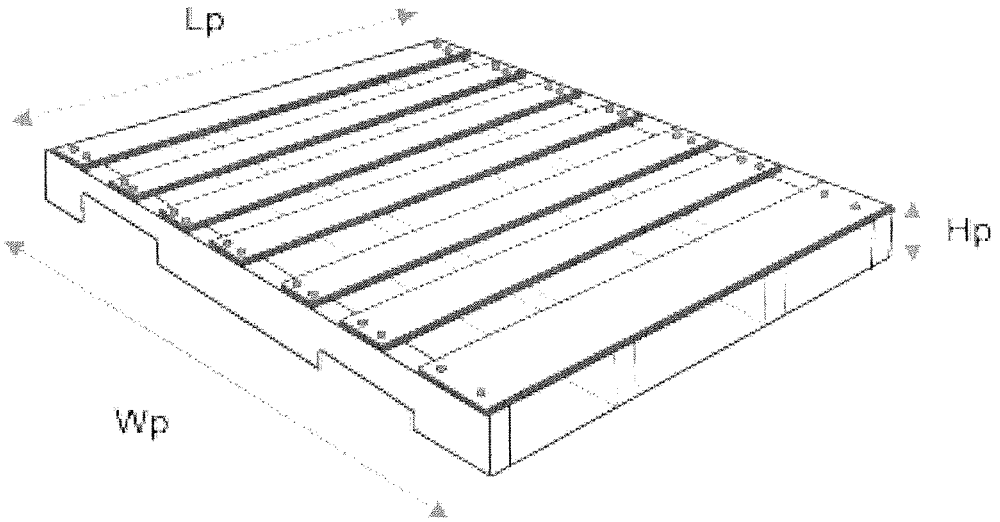
FIG. 1 depicts an example of a pallet.

In one embodiment, the pallet comprises a top surface, a bottom surface and a height ($H_P$), a width ($W_P$) and a length ($L_P$). See, for example, FIG. 1. In embodiments, the pallet is a conventional pallet, as known in the art. In embodiments, the pallet can be fabricated of wood, plastic, metal and/or recycled materials. The top surface of the pallet can be a single piece or a plurality of parallel spaced slats (as shown in FIG. 1). In embodiments, the pallet is square-shaped or rectangular-shaped. Examples of typical pallet dimensions (width×length) include 40 inches×48 inches (101.6 cm×121.9 cm), 42 inches×42 inches (106.7 cm×106.7 cm), although the dimensions can vary as desired.

In one embodiment, the support structure comprises an opening to allow for placement of the support structure over bagged goods stacked on the pallet.

In one embodiment, the support structure includes at least four sidewalls.

In one embodiment, the support structure is constructed from at least one of the following: cardboard, wood, plastic, metal, or combinations thereof. In one embodiment, the support structures comprises recycled cardboard, wood, plastic, metal, or combinations thereof.

In one embodiment, the support structure is be formed from a composition comprising at least one olefin-based polymer, for example, a high density polyethylene (HDPE).

In one embodiment, the support structure is be formed from a composition comprising a rigid thermoplastic, for example, polystyrene, polycarbonate, HDPE, or combinations thereof.

In one embodiment, the support structure is be fabricated from a single piece of rigid material. In one embodiments, the support structure can be erected from a single, unitary blank of corrugated cardboard with the sidewalls (i.e., top wall and at least two side panels) being foldable and attached together by a fastener (e.g., tabs received in slots, strapping, etc.). In one embodiment, the support structure is fabricated from a molded plastic or recycled material.

Figure 2:
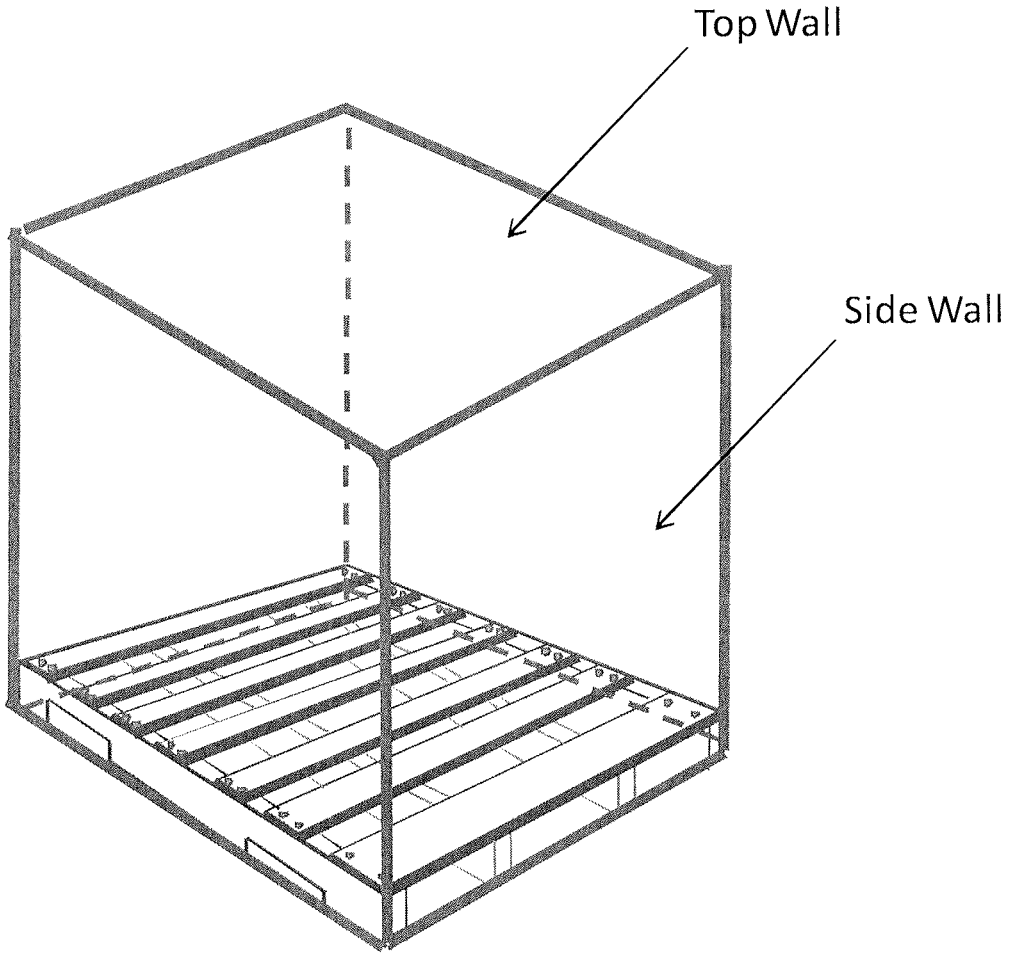
FIG. 2 depicts an example support structure placed over a pallet.

The sidewalls of the support structure are generally oriented perpendicular (or at a right angle) to the top wall. As illustrated in FIG. 2, with the support structure mounted over a load of bagged goods (not shown) situated on the pallet, at least two of the side panels are in a vertical (perpendicular) orientation (i.e., at a right angle) to the top surface of the support structure. In the illustrated embodiment, the support structure is open at the bottom.

Figure 3:
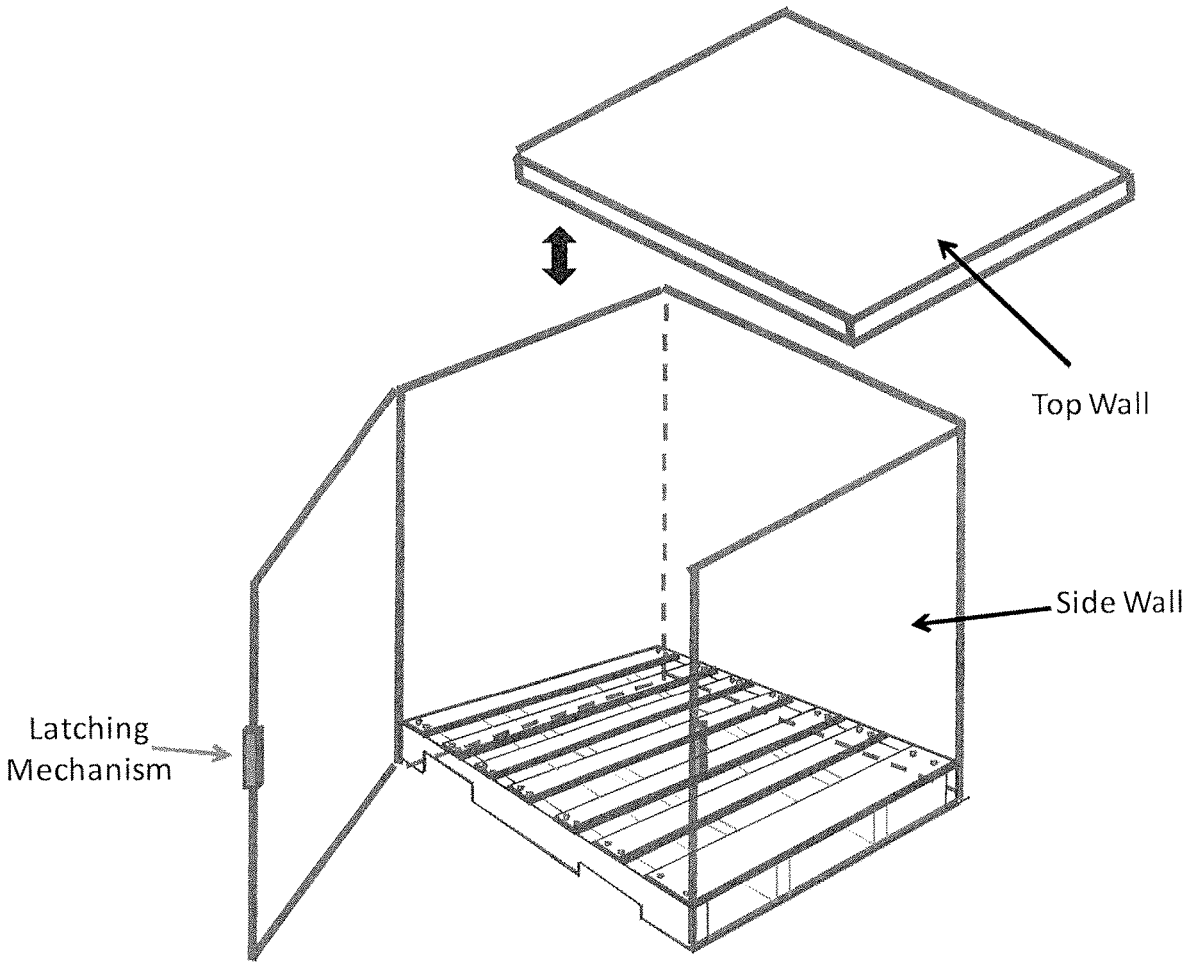
FIG. 3 depicts an example support structure placed over a pallet, and where the support structure has a removable top wall and a latching mechanism.

An additional embodiment of a support structure is illustrated in FIG. 3. As illustrated in FIG. 3, the support structure can be configured with four sidewalls including a detachable top wall.

In one embodiment, the support structure is configured with a removable top wall mounted onto, and fitting over, the sidewalls. For example, see FIG. 3.

In one embodiment, the support structure is positioned over a stack of bagged goods comprising ≥2, or ≥3, or ≥4, or ≥5, or ≥6, or 7, or ≥8 layers of bagged goods. For example, see FIG. 4*a*.

In one embodiment, the layers of bagged goods can be arranged in alternating patterns to provide a stable load of stacked bagged goods.

In one embodiment, the bagged good can contain polymer pellets, and further an elastomeric polymer pellets.

Figure 6:
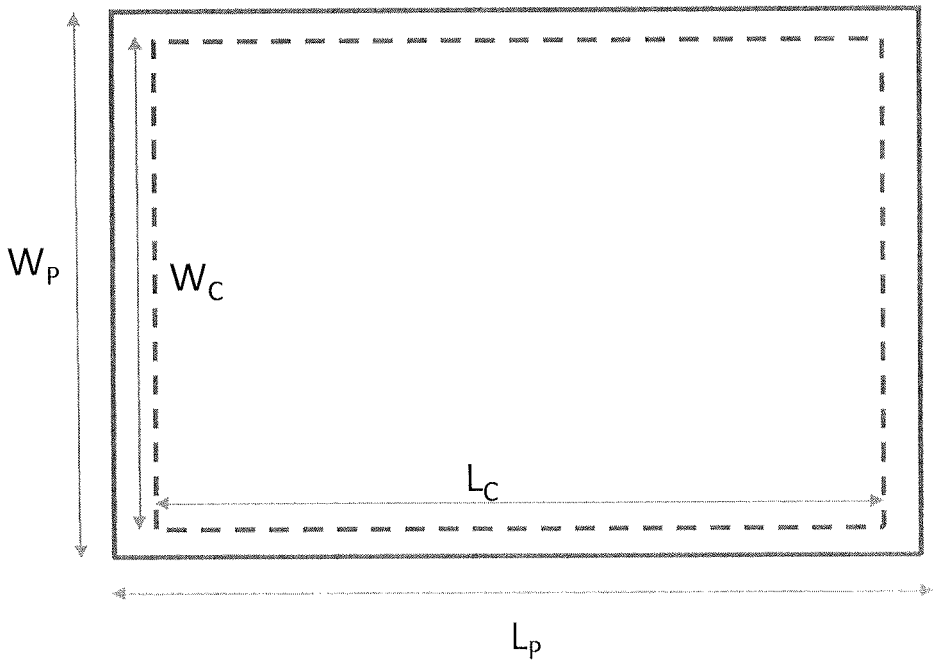
FIG. 6 depicts a top plan view of the packaging configuration of FIG. 5*b* taken along lines 6-6, in which the support structure is dimensioned such that the width ($W_C$) of the support structure is less than, or equal to, the width ($W_P$) of the pallet.

In one embodiment, the support structure is dimensioned such that the width ($W_C$) of the support structure is less than, or equal to, the width ($W_P$) of the pallet. For example, see FIG. 6. In one embodiment, both the width ($W_C$) and the length ($L_C$) of the support structure are less than, or equal to, the width ($W_P$) and the length ($L_P$), respectively, of the pallet. In one embodiment, at least the width ($W_C$) of the support structure does not exceed the width ($W_P$) of the pallet, to ensure that two packaging configurations, according to the invention, can be placed side-by-side inside a typical shipping container. For example, in one embodiment, the support structure is situated on the top surface of the pallet that is 40 inches×48 inches (101.6 cm×121.9 cm), and the support structure can have a width ($W_C$) of from 39.5 to 34 inches, and a length ($L_C$) of from 47.5 to 42 inches.

Figure 7:
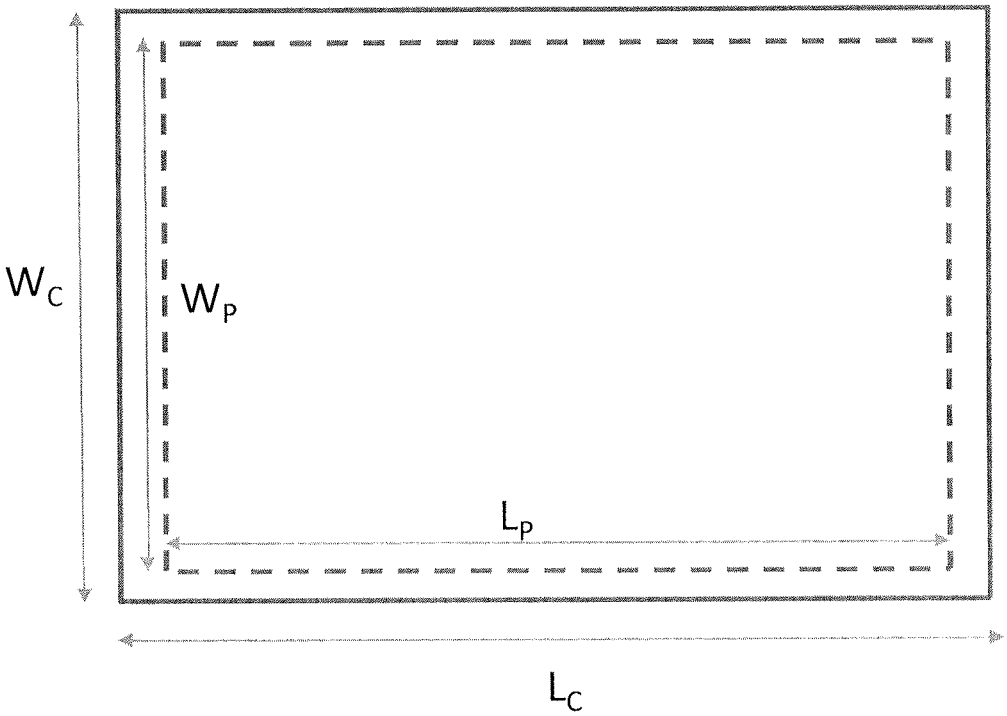
FIG. 7 depicts a top plan view of a packaging configuration of FIG. 4*b* taken along lines 7-7, in which the width ($W_C$) of the support structure is greater than the width ($W_P$) of the pallet.

In one embodiment, the support structure is dimensioned such that the width ($W_C$) of the support structure is greater than the width ($W_P$) of the pallet. In one embodiment, both the width ($W_C$) and the length ($L_C$) of the support structure are greater than the width ($W_P$) and the length ($L_P$), respectively, of the pallet. For example, see FIG. 7. In one embodiment, at least the width ($W_C$) of the support structure exceeds the width ($W_P$) of the pallet. For example, in one embodiment, the support structure is situated on the top surface of the pallet that is 40 inches×48 inches (101.6 cm×121.9 cm), and the support structure can have a width ($W_C$) of from 41.5 to 46 inches, and a length ($L_C$) of from 48.5 to 54 inches.

The rigid support panel functions to enhance the load bearing capacity of the top wall of the support structure. For example, see FIGS. 8*a* and 8*b*. In one embodiment, the rigid support panel includes a first (e.g., top) surface, a second (e.g., bottom) surface, first and second opposing ends, and third and fourth opposing ends. In one embodiment, the rigid support panel has a width ($W_{RS}$), a length ($L_{RS}$) (not shown) and a height ($H_{RS}$). For example, see FIGS. 8*a* and 8*b*. In one embodiment $W_{RS}$ is $\geq W_C$. For example, see FIG. 8*b*.

In one embodiment, the material of construction of the rigid support panel is the same or different than the support structure. In one embodiment, the rigid support panel is fabricated from at least one of wood, plastic, metal, cardboard, or combinations thereof. In embodiments, the rigid support panel is formed from a composition comprising at least one olefin-based polymer, for example, a high density polyethylene (HDPE). In embodiments, the rigid support panel can be a single piece of rigid material. In embodiments, the rigid support panel is composed of a plurality of parallel spaced slats fixed to side supports. In one embodiment, the rigid support panel is a pallet, for example, a conventional wood or plastic pallet, or cardboard pallet, as illustrated in FIG. 1.

In one embodiment, the width ($W_{RS}$) and/or length ($L_{RS}$) dimensions of the rigid support panel are such that at least two opposing ends of the rigid support panel extend beyond the edge of the top wall and over the top ends of at least two of the vertical side panels of the support structure. For example, see FIGS. 8*a* and 8*b*. As such, the rigid support panel is supported at the edges of the support structure and the vertical side panels of the support structure function as load-bearing walls to carry (or transfer) the load stress (weight) of the rigid support panel and the stacked upper load of bagged goods down to the bottom of the pallet, or down to the ground, building floor, rack, grid or other surface.

In one embodiment, the rigid support panel has a width ($W_{RS}$) and/or length ($L_{RS}$) that is at least 1 cm, or at least 2 cm, or at least 3 cm, or at least 4 cm, or at least 5 cm, greater than the corresponding width ($W_C$) and/or length ($L_C$), respectively, of the support structure. In embodiments, the rigid support panel extends beyond the edge of the top wall by a distance of at least at least 1 cm, or at least 2 cm, or at least 3 cm, or at least 4 cm, or at least 5 cm.

To prevent placing weight (stress) by an upper load of bagged goods onto the lower load of bagged goods, the packaging configuration is structured to provide an air gap between the top layer of the lower load of bagged goods and the top wall of the support structure, the air gap having a height ($H_{AG}$). For example, see FIG. 4*a*. In general, the height ($H_{AG}$) of the air gap should be greater than the maximum deflection of the top wall of the support structure under static and dynamic loads and ambient conditions (including temperature and pressure), experienced during shipment.

In one embodiment, the strength of the top wall of the support structure is such that the maximum downward deflection of the top wall under static and/or dynamic loads (e.g., the combined weight of the rigid support panel and the upper load of bagged goods) and ambient conditions experienced during shipment, is less than the height of the air gap ($H_{AG}$). In embodiments, the combined strength of the top wall of the support structure and the rigid support panel is such that the maximum deflection of the top wall under static and/or dynamic loads and ambient conditions experienced during shipment is less than the height of the air gap ($H_{AG}$).

In one embodiment, the top wall of the support structure is sufficiently rigid and strong to support the second (upper) load of bagged goods and maintain a sufficient air gap without the use of a rigid support panel. The top wall can be fabricated from the same or a different material than the support structure. In embodiments, the top wall is fabricated from a rigid material such as, for example, cardboard or HDPE. In embodiments, the top wall of the support structure is integral with the sidewalls. For example, see FIG. 2. In other embodiments, the top wall of the support structure comprises a removable cover. For example, see FIG. 3.

In one embodiment, the support structure is dimensioned with a height ($H_C$) that is sufficient to provide an air gap between the top layer of the lower load of bagged goods and the top wall of the support structure.

In one embodiment, the total height ($H_{L1}$) of the lower load of bagged goods can be adjusted to provide a sufficient air gap between the top layer of the bagged goods and the top wall of the support structure.

In one embodiment, the height ($H_{AG}$) of the air gap is at least 1 cm, or at least 2 cm, or at least 3 cm, up to 8 cm, or up to 7 cm. In one embodiment, the height ($H_{AG}$) of the air gap can range from 1 to 8 cm, or from 1 to 7 cm or from 1 to 6 cm, or from 1 to 5 cm, or from 1 to 4 cm.

In one embodiment, the bottom surface of the support structure is situated on the top surface of the pallet, the height ($H_C$) of the support structure is greater than (>) the total height ($H_{L1}$) of the lower load of bagged goods stacked on the pallet. For example, see FIG. 5*a*.

Film-Wrapped Packaging Configuration

In one embodiment, the components of the packaging configuration can be secured together by at least one plastic film. For example, see FIG. 9. As such, the film-wrapped packaging configuration has sufficient integrity to hold the components together during shipment.

In one embodiment, the packaging configuration comprises a support structure situated over a first (lower) load of bagged goods stacked on a pallet, with the support structure and the pallet with the load of stacked bagged goods secured together by at least one plastic film.

In one embodiment, the packaging configuration comprises a support structure situated over a first (lower) load of bagged goods stacked on a pallet, a rigid support panel situated on top of the support structure, and a second (upper) load of bagged goods stacked on the rigid support panel, with the support structure, the pallet with the first (lower) load of stacked bagged goods and the rigid support panel with the second (upper) load of stacked bagged goods secured together by at least one plastic film.

In one embodiment, the plastic film comprises a shrink-wrap film or a stretch hood packaging film, as known and used in the art. In embodiments, the plastic film comprises a mono- or multilayer film structure based on an ethylene-based polymer.

Method

In yet another aspect, a method of securing one or more stacks of bagged goods on a pallet is provided.

In an embodiment, the method comprises:

A. providing a pallet having a top surface, a bottom surface and a height ($H_P$), and a first stack bagged goods, stacked on the top surface of the pallet;

B. providing a support structure having a top wall and at least three sidewalls, an and a height ($H_C$), wherein the three of the sidewalls are in a perpendicular orientation relative to the top wall; and C. placing the support structure over or around the first stack of bagged goods;

wherein an air gap is situated between a top layer of the first stack of bagged goods and the top wall of the support structure, and the air gap has a height ($H_{AG}$).

In one embodiment, the open bottom end of the support structure is positioned on the top surface of the pallet, and the height of the support structure ($H_C$) is greater than (>) the height of the first stacked of bagged goods.

In one embodiment, the support structure encloses the pallet, and the bottom surface of the support structure is positioned on the same surface as the bottom surface of the pallet, and the height of the support structure ($H_C$) is greater than (>) the combined height of the pallet ($H_P$) and the height of the first stack bagged goods ($H_L$).

In one embodiment, the method further comprises placing a rigid support panel over the top wall of the support structure. In one embodiment, the method further includes placing a second (upper) stack of bagged goods on the rigid support panel.

In one embodiment, the method includes securing together at least the support structure and the pallet (with the first (lower) stack bagged goods) by a plastic film.

Definitions

Unless stated to the contrary, implicit from the context, or customary in the art, all parts and percents are based on weight, and all test methods are current as of the filing date of this disclosure.

For purposes of United States patent practice, the contents of any referenced patent, patent application or publication are incorporated by reference in their entirety (or its equivalent US version is so incorporated by reference) especially with respect to the disclosure of synthetic techniques, product and processing designs, polymers, catalysts, definitions (to the extent not inconsistent with any definitions specifically provided in this disclosure), and general knowledge in the art.

The terms "top," "bottom," "upper," "lower," "over," "under," "overlying," "underlying," and the like, in the description and in the claims, if any, are used for descriptive purposes, and not necessarily for describing permanent relative positions. It is understood that the terms so used are interchangeable under appropriate circumstances such that the example embodiments of the invention described herein are, for example, capable of operation in other orientations than those illustrated or otherwise described herein.

The term "packaging configuration," as used herein, refers to an assembly for packaging goods, and which assembly comprises at least a pallet, a stack of bagged goods, and a support structure as described herein.

The term "pallet," as used herein, refers to a portable, rigid and flat structure used for storing and/or transporting goods, and which can be moved using a fork-lift truck. A pallet comprises at least one top surface surfaces, upon which packaged goods are stacked. A pallet may be formed from one or more types of wood, one or more types of plastics, one or more metals, or any combination thereof. See, for example, FIG. 1. The height of the pallet ($H_P$) is measured from the point of contact of the pallet with the ground to the point of contact of the top surface of the pallet with the bag(s) stacked on it.

The phrase "stack of bagged goods," as used herein, refers to multiple (≥2) layers of bagged goods, with one layer serving as a base layer, and a second layer positioned on top of the base layer. An additional layer may by positioned on top of the second layer, and so forth. The height of the first stack bagged goods ($H_{L1}$) is determined by measuring the distance between the point of contact of the first stacked of bagged goods on the pallet, and the top of bag on the last layer of the first stacked of bagged goods.

The term "support structure," as used herein, refers to a structure that reduces the consolidation stress (from upper layers of bagged goods) on the bottom layers of a stack of bagged goods. The structure comprising at least four walls, wherein one of the walls is a top wall, and wherein at least three of the walls are in a perpendicular orientation to the top wall, and wherein the support structure has a height ($H_C$) as described herein.

The phrase "perpendicular orientation," as used herein, refers to a 90°±5° angle (or an angle from 85° to 95°) between the top wall and each respective sidewall of the support structure.

The phrase "aligned with," as used herein, with respect to the support structure, refers to the parallel placement of two opposing sidewalls of the support structure, each with the respective opposing outer edge of the pallet. Each parallel placement is within five degrees from the longitudinal outer edge of the pallet.

The term "air gap," as used herein refers to the space between the top surface of the last layer of the first stack of bagged goods and the lower surface of the top wall of the support structure. The air gap has a height ($H_{AG}$) which is measured from the top surface of the last layer of the first stack of bagged goods to the internal surface of the top wall of the support structure.

The term "ambient conditions," as used herein, refers to the environmental conditions that surround a given area. These conditions include temperature, pressure, humidity, noise, and light; however, typically, the relevant parameters are air temperature, air pressure and humidity (for example, room temperature, atmospheric pressure and relative humidity).

"Load" and like terms, as used herein, refers to a mechanical force or weight applied on an object or system.

"Static load" and like terms, as used herein, refers to a force that is constant, not changing in magnitude or position with time.

"Dynamic load" and like terms, as used herein, refers to a force that changes with time.

"Consolidation stress" and like terms, as used herein, refers to the "static load" placed on the bottom layer of a stack of bagged goods.

"Bulk Density" and like terms, as used herein, refers to the mass of particles of the material, for example, pellets, divided by the total volume they occupy. The total volume includes particle volume, inter-particle void volume, and internal pore volume.

"Maximum deflection," "maximum downward deflection" and like terms, as used herein, refers to the degree (i.e., distance) to which a structural element (e.g., top wall of the support structure) is displaced under a load.

The term "olefin-based polymer," as used herein, refers to a polymer that comprises, in polymerized form, a majority weight percent of olefin (for example ethylene or propylene), based on the weight of the polymer, and optionally may comprise one or more comonomers.

The term "ethylene-based polymer," as used herein, refers to a polymer that comprises, in polymerized form, a majority weight percent of ethylene, based on the weight of the polymer, and optionally may comprise one or more comonomers.

The terms "massing," "blocking," or similar terms, as used herein, refer to the increased agglomeration and/or decreased flow of a material, for example polymer pellets, due to the time, temperature and/or stress experienced by the material.

The term "shrink-wrap film," as used herein, refers a protective wrapping for articles of merchandise, and consisting of a plastic film that is wound about the articles, and then shrunk by heat to form a sealed, tight-fitting package.

The term "stretch hood packaging film," as used herein, refers a tube of film sealed on one end, and which is stretched over goods, for example a palletized load, to secure the contents to the load. The film is cut to the appropriate length, heat scaled on the top end, and gathered on four fingers. These fingers stretch the film in the horizontal (transverse) direction, until the film dimensions are slightly larger than the load dimensions, then draw the stretched film down over the load or pallet, unrolling it as they go. By varying the unrolling rate, a degree of vertical (machine) direction stretch can be obtained to better hold the load on the load or pallet. At the bottom of the load or pallet, the fingers release the film, which typically wraps under the load or pallet bottom.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of"

excludes from the scope of any succeeding recitation any other component, step or procedure, excepting those that are not essential to operability. The term "consisting of" excludes any component, step or procedure not specifically delineated or listed.

The term "rigid support panel" as used herein refers to a rigid structure (e.g., a pallet, a flat sheet, etc.) made of a rigid material, such that the material is capable of withstanding the stress, due to a top load, within an acceptable limit of deflection that is less than the height of the air gap ($H_{AG}$).

EXAMPLE

In a Comparative Example, bags containing pellets of ENGAGE™ 7467 polyolefin elastomer were stacked eleven (11) layers high in a conventional pallet configuration and subjected to ambient temperatures cycling between 30 and 37° C. in a warehouse during summer for six weeks. The bags were then unloaded starting from the top layer. For each layer, observations were made regarding the extent of massing of the pellets in the bag. The results are summarized in Table 1 below. The experiment was repeated and similar results were obtained.

As shown in Table 1, the elastomeric pellets do not exhibit massing tendency when the load stress on a layer compared to the load stress on the bottom layer is less than fifty percent (50%).

TABLE 1

Comparative Example: Observations for massing of ENGAGE ™ 7467 pellets after 6 weeks storage (bag height = 6.4 inches, bulk density = 30 lb/ft$^3$)

| Layer # | Calculated Stress on Top Surface of Bag, lb/ft2 | % Stress Compared To Bottom Layer (#11) | Observations |
|---|---|---|---|
| 1 - Top Layer | 0.0 | 0 | Free-Flowing |
| 2 | 15.9 | 10 | Free-Flowing |
| 3 | 31.8 | 20 | Free-Flowing |
| 4 | 47.7 | 30 | Free-Flowing |
| 5 | 63.6 | 40 | Free-Flowing |
| 6 | 79.5 | 50 | Mostly Free-Flowing |
| 7 | 95.5 | 60 | Massing Worse than Layer #6 |
| 8 | 111.4 | 70 | Massing Worse than Layer #7 |
| 9 | 127.3 | 80 | Massing Worse than Layer #8 |
| 10 | 143.2 | 90 | Massing Worse than Layer #9 |
| 11 - Bottom Layer | 159.1 | 100 | Massing Worse than Layer #10 |

The Inventive Example (below) represents a packaging configuration as shown in FIG. 4 (without the reinforced top wall). As shown in Table 2, the elastomeric pellets do not exhibit massing at any of the applied loads. The results indicate that reduction in load stress on bagged elastomeric pellets, as provided in the packaging configuration of the invention, will reduce massing tendency.

TABLE 2

Inventive Example: Improvement in product flowability due to reduced stress on the bags in the new pallet configuration

| Load Configuration | Layer # | Calculated Stress on Top Surface of Bag, lb/ft2 | % Stress Compared To Bottom Layer (#11) | Observations |
|---|---|---|---|---|
| Top Load | 1 - Top Layer | 0.0 | 0 | Free-Flowing |
| Top Load | 2 | 15.9 | 10 | Free-Flowing |
| Top Load | 3 | 31.8 | 20 | Free-Flowing |
| Top Load | 4 | 47.7 | 30 | Free-Flowing |
| Top Load | 5 - Bottom Layer | 63.6 | 40 | Free-Flowing |
| Bottom Load | 1 - Top Layer | 0.0 | 0 | Free-Flowing |
| Bottom Load | 2 | 15.9 | 10 | Free-Flowing |
| Bottom Load | 3 | 31.8 | 20 | Free-Flowing |
| Bottom Load | 4 | 47.7 | 30 | Free-Flowing |
| Bottom Load | 5 | 63.6 | 40 | Free-Flowing |
| Bottom Load | 6 - Bottom Layer | 79.5 | 50 | Mostly Free-Flowing |

It is specifically intended that the present invention not be limited to the embodiments and illustrations contained herein, but include modified forms of those embodiments including portions of the embodiments and combinations of elements of different embodiments as come within the scope of the following claims.

The invention claimed is:

1. A packaging configuration comprising at least the following:

A. A pallet comprising a top surface, a bottom surface and a height ($H_P$);

B. A first stack of bagged goods, stacked on the pallet, each bagged good being a bag containing from 20 kg to 25 kg free-flowing elastomeric polymer pellets;

the first stack of bagged goods comprising at least five layers of bagged goods, with one layer being a bottom layer, the flowable pellets in the bottom layer susceptible to massing when the bottom layer is subjected to consolidation stress; and wherein the first stack of bagged goods has a total height ($H_{L1}$); and C. A support structure situated over, and at least partially enclosing, the first stack of bagged goods, the support structure comprising at least four walls, wherein one of the walls is a top wall, and wherein at least three of the walls are sidewalls that are each, independently, in a perpendicular orientation to the top wall, and wherein the support structure has a height ($H_C$) that meets one of the following equations:

(i) $H_C > H_{L1}$, when the bottom end of at least one sidewall of the support structure is positioned on the top surface of the at least one pallet; or (ii) $H_C > H_P + H_{L1}$, when the bottom end of at least one sidewall of the support structure and the bottom surface of the pallet are both positioned on the same surface;

wherein an air gap is situated between a top layer of the first stack of bagged goods and the top wall of the support structure, and the air gap has a height ($H_{AG}$); and wherein the top wall is detachable from the side walls; and D. a second stack of bagged goods, the second stack stacked directly on the detachable top wall, each bagged good of the second stack of bagged goods containing from 20 kg to 25 kg free-flowing elastomeric polymer pellets, the second stack comprising at least three layers with one layer being a bottom layer, the flowable pellets in the second stack bottom layer susceptible to massing when the second stack bottom layer is subjected to consolidation stress; and the packaging configuration maintains the pellets as free-flowing when each bagged good is removed from the pallet and opened.

2. The packaging configuration of claim 1, wherein the height ($H_{AG}$) of the air gap is from 1 cm to 6 cm.

3. The packaging configuration of claim 1, wherein the support structure comprises a latching mechanism.

4. The packaging configuration of claim 2, wherein the strength of the top wall of the support structure is such, that the maximum deflection under a static load or under a dynamic load, each at ambient conditions, is less than the height of the air gap ($H_{AG}$).

5. The packaging configuration of claim 1, wherein the packaging configuration is secured together by at least one plastic film.

6. The packaging configuration of claim 1 wherein each bagged good has a bulk density of 30 lb/ft$^3$.

7. The packaging configuration of claim 6 wherein the elastomeric polymer of the pellets has a density less than 0.875 g/cm$^3$.

8. The packaging configuration of claim 1 wherein the detachable top wall has a width that is greater than the width of the support structure.

9. The packaging configuration of claim 5, wherein the plastic film is a shrink-wrap film.

10. The packaging configuration of claim 1, wherein the first stack comprises at least six layers and the second stack comprises at least five layers.

11. The packaging configuration of claim 10 wherein the second stack bottom layer has a percent change of stress (Δ) no greater than 50%, wherein the percent change of stress is defined by the following equation:

$$\Delta = \frac{H_{L2}}{(H_{L1} + H_{L2})} * 100.$$

12. The packaging configuration of claim 11, wherein the first stack consists of six layers and the second stack consists of five layers.

13. A method of securing one or more stacks of bagged goods on a pallet, said method comprising packaging the bagged goods using the packaging configuration of claim 1.

* * * * *